United States Patent [19]

Raybould

[11] Patent Number: 4,582,536

[45] Date of Patent: Apr. 15, 1986

[54] PRODUCTION OF INCREASED DUCTILITY IN ARTICLES CONSOLIDATED FROM RAPIDLY SOLIDIFIED ALLOY

[75] Inventor: Derek Raybould, Denville, N.J.

[73] Assignee: Allied Corporation, Morris Township, Morris County, N.J.

[21] Appl. No.: 679,423

[22] Filed: Dec. 7, 1984

[51] Int. Cl.[4] ..... B22F 3/00

[52] U.S. Cl. ..... 75/246; 75/126 A; 75/126 P; 419/23; 419/30; 419/33; 419/28; 419/29; 419/41; 419/48; 419/50; 420/436; 420/437; 420/439; 420/442; 420/445; 420/451

[58] Field of Search ..... 419/23, 30, 28, 33, 419/29, 48, 41, 50; 75/246, 126 A, 126 P; 420/436, 437, 439, 442, 445, 451

[56] References Cited

U.S. PATENT DOCUMENTS

| | | | |
|---|---|---|---|
| 4,347,076 | 8/1982 | Ray et al. | 75/249 |
| 4,365,994 | 12/1982 | Ray | 75/123 |
| 4,395,464 | 7/1983 | Panchanathan et al. | 419/48 |
| 4,404,028 | 9/1983 | Panchanathan et al. | 419/48 |
| 4,410,490 | 10/1983 | Ray et al. | 419/30 |
| 4,473,402 | 9/1984 | Ray et al. | 419/33 |

FOREIGN PATENT DOCUMENTS 1562788 3/1980 United Kingdom .

OTHER PUBLICATIONS

E. R. Thompson, "High Temperature Aerospace Materials Prepared by Powder Metallurgy", 1982, pp. 213–242.

S. K. Das, et al., "Ni–Mo–B Alloys:Metallic Glass to Ductile Crystalline Solid", Dec. 6–8, 1982.

D. Raybould, "Ultra Rapidly Solidified Alloys for Dies, Tool and Wear Parts", May 1984.

F. L. Jagger, et al., "Production of Sintered High–Speed–Steel Cutting–Tool Materials from Prealloyed Powders", Jun. 2, 1981.

M. T. Podab, et al., "The Mechanism of Sintering High Speed Steel to Full Density", 1981.

C. C. Wan, "Crystallization Behavior and Properties of Rapidly Solidified Ni–Mo–B Alloys", 1981.

*Primary Examiner*—Stephen J. Lechert, Jr.

*Attorney, Agent, or Firm*—Paul Y. Yee; James Riesenfeld; Gerhard H. Fuchs

[57] ABSTRACT

The present invention provides a method for consolidating rapidly solidified, transition metal alloys which includes the step of compacting a plurality of alloy bodies at a temperature ranging from about 0.90–0.99 Tm (melting temperature in °C.) for a time period ranging from about 1 min to 24 hours. The alloy bodies contain at least two transition metal elements and consist essentially of the formula (Fe,Co and/or Ni)$_{bal}$(W, Mo, Nb and/or Ta)$_a$(Al and/or Ti)$_b$(Cr)$_c$(B and/or C)$_d$(Si and/or P)$_e$, wherein "a" ranges from about 0–40 at. %, "b" ranges from about 0–40 at. %, "c" ranges from about 0–40 at. %, "d" ranges from about 5–25 at. %, and "e" ranges from about 0–15 at. %. The alloy bodies also have a substantially homogeneous and optically featureless structure.

A consolidated article produced in accordance with the present invention has increased ductility and toughness; with a tensile strength of at least about 1200 MPa and an impact resistance of at least 10 Joules (unnotched charpy test). The article is composed of a crystalline, transition metal alloy, which has an average grain size of greater than 3 micrometers and contains separated precipitate particles ranging from about 3–25 micrometers in average size.

19 Claims, 4 Drawing Figures

PRODUCTION OF INCREASED DUCTILITY IN ARTICLES CONSOLIDATED FROM RAPIDLY SOLIDIFIED ALLOY

DESCRIPTION

Background of the Invention

1. Field of the Invention

The invention relates to three dimensional articles consolidated from alloys which have been rapidly solidified from the melt. In particular, the invention relates to articles which have been consolidated from rapidly solidified alloys and have increased strength, ductility and toughness.

2. Brief Description of the Prior Art

Heterogeneities in ordinary cast material, such as conventional nickel based superalloys, can render the alloys unworkable and therefore unusable. Even after thermal and mechanical homogenizing treatments, the alloy can still retain undesirable inhomogeneities from the casting. Such homogenizing treatments are also expensive and time consuming. For example, to reduce the microsegregation of a refractory element in nickel to 5% of its initial value in an alloy with a 200 micrometer dendrite arm spacing, can require a heat treatment of about one week at 1200° C. The homogenization time depends on the square of the dendrite arm spacing.

Rapid solidification produces finer microstructures and more highly alloyed material than that produced by conventional casting or conventional powder metallurgy. For example, increasing the solidification rate decreases the dendrite arm spacing. In the optimum case, a rapid solidification rate of around $10^{5°}$ C./sec and over, such as obtained by melt spinning, forms a substantially homogenous structure in the alloy. The problem then becomes one of minimizing segregation in the alloy during high temperature consolidation.

The high strength of these powders and their reactive nature generally prohibits their consolidation by standard techniques, such as press and sinter. They are usually consolidated by techniques, such as Hot Isostatic Pressing (HIP), which involve the combined application of pressure and heat. This combination allows the use of lower temperatures than the process of sintering, where heat alone is used. Even so, for powders solidified at $10^{3°}$ to $10^{4°}$ C./sec, it is desirable to mechanically deform the powder prior to HIP'ing because this activates the powder and allows the use of lower HIP temperatures, thus avoiding undesirable segregation during consolidation. Similarly, high pressure techniques, such as the fluid die pressing/rapid omnidirectional consolidation technique, are of interest, because they use much higher pressures than HIP [×10]. These techniques allow consolidation at lower temperatures and employ shorter times at temperature. Innovative techniques which retain the structure of the starting powder have been reviewed by E. R. Thompson, "High Temperature Aerospace Materials Prepared by Powder Metallurgy", Annual Review of Material Science, 1982, 12, pp. 213–242.

The conventional practice for consolidating prealloyed powders, especially those produced by rapid solidifaction, has been to expose them to the minimum temperature consistent with attaining full consolidation. For example, tool steel powder is usually produced by argon or water atomization (cooling rate of $10^{3°}$ to $10^{4°}$ C./sec), which provides a powder having a fine microstructure. However, while the precipitates are nominally fine, a few large precipitates are also present. These large precipitates can grow rapidly at high consolidation temperatures, reduce the strength and toughness of the material, and can often result in localized melting. Processes, such as those disclosed in British Patent No. 1,562,788 for the production of tool steel drills, reamers, end mills, etc., employ a temperature which is a compromise between achieving a high density and avoiding localized melting. This necessitates extremely accurate temperature control; a furnace temperature in the order of 1200°±5° C. being normal. Such control is of course difficult and expensive. Also, the toughness of the material tends to be low because sufficiently high temperatures for full consolidation cannot be employed.

U.S. Pat. No. 4,439,236 to R. Ray discloses boron-containing transition metal alloys based on one or more of iron, cobalt and nickel. The alloys contain at least two metal components and are composed of ultra fine grains of a primary solid solution phase randomly interspersed with particles of complex borides. The complex borides are predominately located at the junctions of at least three grains of the primary solid-solution phase. The ultra fine grains of a primary solid solution phase can have an average size, measured in their longest dimension, of less than about 3 micrometers. The complex boride particles can have an average particle size, measured in their largest dimension, of less than about 1 micrometer as viewed on a microphotograph of an electron microscope. To make the alloys taught by Ray, a melt of the desired composition is rapidly solidified to produce ribbon, wire, filament, flake or powder having an amorphous structure. The amorphous alloy is then heated to a temperature ranging from about 0.6–0.95 of the solidus temperature (measured in ° C.) and above the crystallization temperature to crystallize the alloy and produce the desired microstructure. Amorphous alloy ribbon, wire, filament, flake or powder taught by Ray can also be consolidated under simultaneous application of pressure and heat at temperatures ranging from about 0.6–0.95 of the solidus temperature to produce high strength, high hardness articles having some ductility.

Other boron-containing transition metal alloys have been conventionally cooled from the liquid to the solid crystalline state. Such alloys can form continuous net works of complex boride precipitates at the crystalline grain boundaries. These networks can decrease the strength and ductility of the alloy.

However, transition metal alloys processed by known methods, such as those discussed above, have not produced consolidated articles having desired levels of toughness and ductility.

SUMMARY OF THE INVENTION

The present invention provides a method for consolidating rapidly solidified, transition metal alloys. The method includes the step of selecting a rapidly solidified alloy, which has been solidified at a quench rate of at least about $10^{5°}$ C./sec and has a substantially homogeneous, optically featureless alloy structure. The rapidly solidified alloy is formed into a plurality of separate alloy bodies, and these alloy bodies are heated to a temperature ranging from about 0.90–0.99 Tm for a time period ranging from about 1 min to 24 hr. Additionally, the alloy bodies are compacted to produce a consolidated article composed of a crystalline alloy, which has an average grain size of at least about 3 micrometers and contains a substantially uniform dispersion of separate precipitate particles having an average diameter ranging from about 3–25 micrometers. The method of the present invention advantageously consolidates rapidly solidified powders at temperatures much higher than those employed in conventional methods. The method employs these higher consolidation temperatures without inducing excessive preferential growth of large precipitates and without inducing localized melting.

The invention further provides a consolidated article with increased ductility and toughness. The article is composed of a crystalline, transition metal alloy consisting essentially of the formula $M_{bal}T_aR_bCr_cX_dY_e$, wherein "M" is at least one element selected from the group consisting of Fe, Co and Ni, "T" is at least one element selected from the group consisting of W, Mo, Nb and Ta, "R" is at least one element selected from the group consisting of Al and Ti, "X" is at least one element selected from the group consisting of B and C, "Y" is at least one element selected from the group consisting of Si and P, the subscripts "a" through "e" are expressed in atom percent, "a" ranges from about 0–40, "b" ranges from about 0–40, "c" ranges from about 0–40, "d" ranges from about 5–25, and "e" ranges from about 0–15, plus incidental impurities, with the proviso that the alloy contains at least two transition metal elements. The consolidated alloy has a grain size of at least about 3 micrometers and has separated precipitate particles ranging from about 3 to 25 micrometers in average diameter. These precipitates are substantially uniformly dispersed throughout the alloy. The consolidated article has a tensile strength of at least about 1200 MPa and sufficient toughness to resist an impact energy of at least about 10 Joules in an unnotched charpy test.

Thus, the invention provides an improved method for processing rapidly solidified transition metal alloys to produce an advantageous combination of strength and toughness desired for various structural applications. Consolidated articles produced from the alloys are substantially free of continuous networks of precipitates, and are particularly useful for machine tooling and the like.

BRIEF DESCRIPTION OF THE DRAWINGS

The invention will be more fully understood and further advantages will become apparent when reference is made to the following detailed description and accompanying drawings in which.

DETAILED DESCRIPTION OF THE INVENTION

Figure 1:
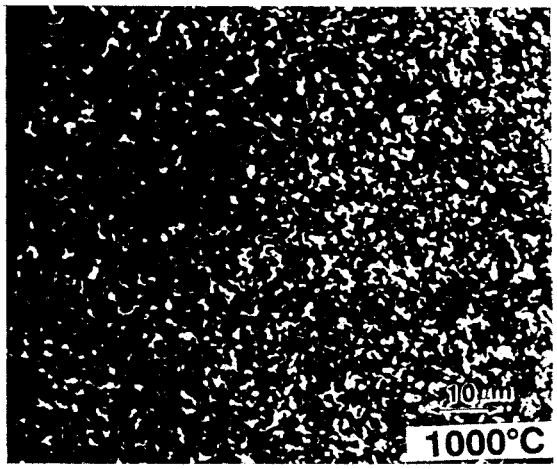
FIG. 1 representatively shows the structure of a consolidated article of the invention compacted at approximately 1000° C.

Alloys that can be employed in the practice of the present invention contain at least two transition metal elements and consist essentially of the formula $M_{bal}T_aR_bCr_cX_dY_e$, wherein "M" is at least one element selected from the group consisting of Fe, Co and Ni, "T" is at least one element selected from the group consisting of W, Mo, Nb and Ta, "R" is at least one element selected from the group consisting of Al and Ti, "X" is at least one element selected from the group consisting of B and C, "Y" is at least one element selected from the group consisting of Si and P, "a" ranges from about 0–40, "b" ranges from about 0–40, "c" ranges from about 0–30, "d" ranges from about 5–25, and "e" ranges from about 0–15, plus incidental impurities, and the subscripts "a" through "e" are expressed in atom percent. In a further aspect of the invention, the alloys employed consist essentially of the formula $M_{bal}'B_{5\text{-}25}X_{0\text{-}20}'$, wherein M' is at least one element selected from the group consisting of Fe, Co, W, Mo and Ni, X' is at least one element selected from the group consisting of C and Si and the subscripts are expressed in atom percent.

Tungsten, molybdenum, niobium, and tantalum increase physical properties such as strength and hardness, and improve thermal stability, oxidation resistance and corrosion resistance in the consolidated product. The amount "a" of the elements is limited because it is difficult to fully melt alloys with compositions greater than the stated amounts and still maintain the homogeneous nature of the alloy.

The elements aluminum and titanium promote a precipitation hardening phase. The volume fraction, of the hardening precipitates, however, must be limited to avoid the formation of networks.

Chromium provides strength and corrosion resistant and the amount of the chromium is set to limit the melting temperature of the alloys.

Boron and carbon provide the borides and carbides which promote hardening in the consolidated alloy. The lower limit for "d" assures sufficient boron and carbon to produce the required borides and carbides. The upper limit assures that continuous networks of the borides and carbides will not form.

Phosphorus and silicon help promote the formation of an amorphous structure in the alloy, and aid in assuring a homogeneous alloy after casting. Silicon is further preferred because it helps provide corrosion resistance in the alloy.

Alloys are prepared by rapidly solidifying a melt of the desired composition at a quench rate of at least about $10^{5°}$ C. per second, employing metal alloy quenching techniques well known to the rapid solidification art; see, for example, U.S. Pat. No. 4,142,571 to Narasimhan, which is hereby incorporated by reference thereto.

Sufficiently rapid quenching conditions produce a metastable, homogeneous material. The metastable material may be glassy, in which case there is no long range order. X-ray diffraction patterns of glassy metal alloys show only a diffuse halo, similar to that observed for inorganic oxide glasses. Such glassy alloys must be at least 50% glassy and preferably are at least 80% glassy to attain desired physical properties. The metastable phase may also be a solid solution to the constituent elements. These metastable, solid solution phases are not ordinarily produced under conventional processing techniques employed in the art of fabricating crystalline alloys. X-ray diffraction patterns of the solid solution alloys show the sharp diffraction peak characteristic of crystalline alloys, with some broadening of the peaks due to the fine grained size of crystallites. The metastable materials can be ductile when produced under the appropriate quenching conditions.

When etched with standard etchant and viewed under an optical microscope at a magnification of about 1000X, the rapidly solidified alloy has a substantially homogeneous and optically featureless structure or morphology. The alloy appears to have a substantially single-phase microstructure, but actually may contain fine grains and perhaps a dispersion of extremely small precipitates.

Alloy bodies, such as filament, strip, flake or powder consisting essentially of the alloy compositions described above, can be consolidated into desired three-dimensional consolidated articles. Suitable consolidation techniques include, for example, hot isostatic pressing (HIP), hot extrusion, hot rolling and the like.

To produce a desired consolidated article, a plurality of separate alloy bodies are compacted at a pressing temperature ranging from about 0.90–0.99 Tm (melting temperature measured in °C.) and for a period ranging from about 1 min to 24 hr. The alloy bodies can be heated to the desired temperature prior to, during or after the compacting operation.

Consolidated articles produced in accordance with the present invention exhibit an advantageous combination of strength and ductility. The articles have an ultimate tensile strength (UTS) of at least about 1200 MPa and a toughness sufficient to sustain an impact energy of at least about 10 Joules (unnotched charpy), both measured at room temperature.

In addition, the consolidated articles of the invention has a distinctive microstructure composed of fine grains of a crystalline matrix having an average grain diameter of greater than 3 micrometers. Separated precipitate particles, consisting essentially of at least one of carbides, borides and silicides, are substantially uniformly dispersed throughout the consolidated article and have an average sizes ranging from about 3–25 microcometers. The grain sizes and precipitate particle sizes can be measured by viewing a microphotograph and employing conventional measurement techniques. By "average size", it is meant the size that one calculates by first determining an average transverse dimension (e.g. diameter) for essentially each of the relevant particles, and then determining an average of these average dimensions.

Figure 3:
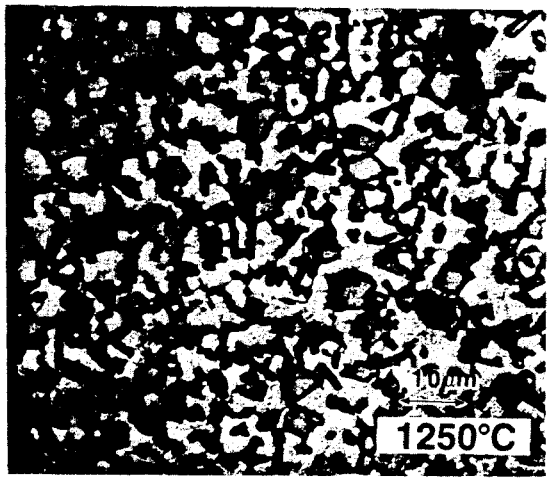
FIG. 3 representatively shows the structure of a consolidated article of the invention compacted at approximately 1250°.

As representatively shown in FIG. 3, the consolidated article of the invention contains a substantially uniform dispersion of separated multifaceted, polygonal precipitate particles. In a particular aspect of the invention, the average size of the individual precipitate particles ranges from about 3–15 micrometers. In a further aspect of the invention, the average size of the grains ranges from about 6–10 micrometers.

The following Examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1–6

A $Ni_{56.5}Mo_{23.5}Fe_{10}B_{10}$ alloy was jet cast by directing a jet of molten alloy onto the peripheral outer surface of a rotating chill wheel to produce ribbon having an amorphous structure. The ribbon was comminuted into powder with particle size of less than 35 mesh, and then consolidated into rods by hot isostatic pressing (HIP). The HIP process included placing the powder into several steel cans, which were then evacuated to a pressure of about 1 Pa or less while being heated to a temperature of around 400° C. The cans were then cooled under vacuum resulting in a pressure at room temperature of about 0.01 Pa or less. While maintaining this low pressure, the cans were welded closed. These cans were then placed in a HIP vessel, which was slowly brought up to the required temperature and pressure.

A can was exposed to a pressure of about 100 MPa and a temperature ranging from about 1050 to 1100° C. for 2 to 4 hours. While the resultant material did have good wear resistance and hot hardness, it also had excessively low toughness.

Figure 2:
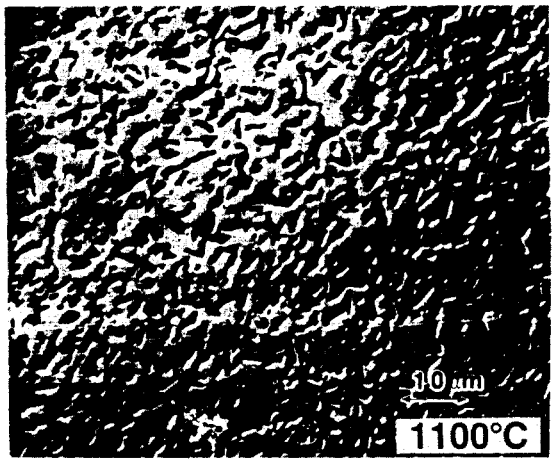
FIG. 2 representatively shows the structure of a consolidated article of the invention compacted at approximately 1100° C.

FIGS. 1 and 2 representatively show the microstructures of alloys compacted at pressing temperatures of 1000° C. and 1100° C., respectively.

Increasing the consolidation pressure did not change the mechanical properties. Increasing temperature and time, however, unexpectedly increased the toughness and ductility. It was surprisingly found that the material could be consolidated at temperatures very close to the equilibrium melting temperature without any deterioration in toughness. Similarly, the microstructure was found to be surprisingly uniform and relatively fine.

For example, after HIP'ing a can at 1250° C. for 2 hours the borides still had a relatively uniform size. While some preferential growth has occurred, as representatively shown in FIG. 3, the amount of such growth was much less than would be expected from such a high temperature.

Generally, preferential growth is observed when certain precipitate particles, which have larger size or have pointed angular shapes, grow faster and with more ease than other precipitate particles. The substantially homogeneous structure of the rapidly solidified alloys, however, greatly reduces the amount of undesired preferential growth.

Figure 4:
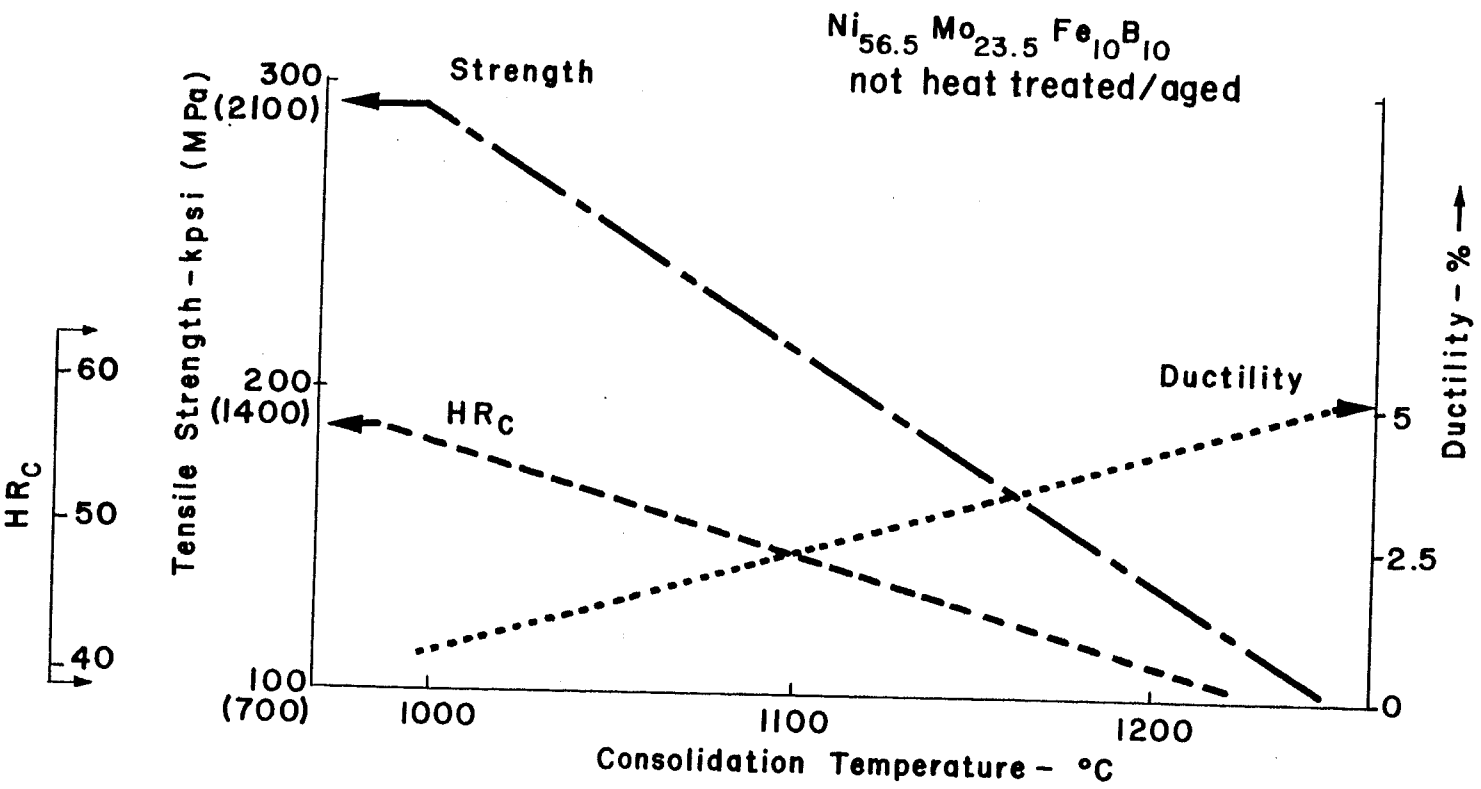
FIG. 4 is a graph which representatively shows the effect of consolidation temperature on the strength, ductility and hot hardness of an article composed of an alloy of the invention.

The toughness and ductility increased in an approximately linear manner even at the highest consolidation temperatures employed, as representatively shown in FIG. 4. In addition strength and hardness decreased as the temperature was increased. Thus, with the same powder batch and employing otherwise identical processing conditions, the use of high temperature consolidation, for example, 1250° C. rather than 1100° C., provides a relatively small decrease in ultimate tensile strength (200–175 Kpsi) while more than doubling the elongation (2–6%) and greatly increasing the toughness (30–50 ft. lbs, unnotched charpy impact test).

Decreasing the HIP temperature decreases the ductility, but increases the strength; for example, HIP'ing at 1000° C., produced an impressive UTS of 280 Kpsi (1.93 $\times 10^3$ MPa). These variations in properties correlate well with the observed boride and grain size as representatively shown in FIGS. 1–3 and in TABLE 1.

The equilibrium temperature at which melting starts for the alloy is around 1270° C., as determined by differential thermal analysis. This indicated that HIP'ing was carried out at 0.98 of the melting temperature (Tm) as measured in °C.

The continuing increase in toughness with consolidation temperature even after long times at temperatures close to the equilibrium melting temperature, plus the relative fine size and uniform distribution of the borides, clearly demonstrates a further advantage which can be derived from the very homogeneous structures produced by rapid solidification techniques.

TABLE 1

| HIP Temperature °C. | Boride Size; Micrometers | $HR_c$ | UTS Kpsi (MPa) | YS Kpsi (MPa) | % El | Unnotched Impact Resistance; ft-lbs (Joules) |
|---|---|---|---|---|---|---|
| 1000 | <1 | 55 | 280 (1950) | — | 0.75 | 10 (13) |
| 1050 | — | 51 | — | — | — | 22 (30) |
| 1100 | 3 | 48 | 200 (1300) | 180 (1250) | 2 | 30 (40) |
| 1150 | — | 48 | 210 (1450) | 175 (1200) | 3 | 32 (43) |
| 1200 | 3.7 | 45 | 190 (1300) | 150 (1050) | 3 | 35 (48) |
| 1250 | 6.0 | 35 | 170 (1200) | 120 (850) | 6 | 50 (68) |

TABLE 1 shows the effect of HIP'ing $Ni_{56.5}Mo_{23.5}Fe_{10}B_{10}$ at different temperatures for 2 hours on the microstructure and mechanical properties. The same powder batch was used for all the tests shown. cl EXAMPLES 7-9

Conventional powders usually show preferential precipitate growth of large precipitates if exposed to a consolidation temperature for a long time. Experiments were, therefore, conducted with a rapidly solidified powder to determine the sensitivity to time at temperature for different temperatures.

A $Ni_{56.5}Mo_{23.5}Fe_{10}B_{10}$ alloy was prepared in accordance with Example 1, and the same conditions for casting, pulverization and HIP'ing were employed. The resultant mechanical properties correlate with the observed microstructures, Table 2. It can be seen that while the toughness and mean boride size did increase with time at temperature, the effect was small except for the high temperature (1250° C.) case. Even for this extreme case, the effect was smaller than would be anticipated from conventional powder metallurgy.

TABLE 2

| HIP Temp. °C. | Time Hrs | Boride Size; Micrometers | $HR_c$ | UTS Kpsi (MPa) | YS Kpsi (MPa) | % El | Unnotched Impact ft-lbs (Joules) |
|---|---|---|---|---|---|---|---|
| 1150 | 1 | — | 49 | 218 (1500) | 183 (1250) | 2.5 | 29 (39) |
| | 2 | — | 48 | 210 (1450) | 175 (1200) | 3.0 | 32 (43) |
| | 4 | — | 48 | 200 (1400) | 170 (1150) | 3.0 | 30 (41) |
| 1200 | 1 | 3.5 | 47 | 200 (1400) | 152 (1050) | 3.0 | 30 (41) |
| | 2 | 3.7 | 45 | 190 (1300) | 150 (1050) | 3.0 | 35 (47) |
| 1250 | 1 | 4.7 | 38 | 176 (1210) | 106 (730) | 5.0 | 40 (54) |
| | 2 | 6.0 | 35 | 170 (1150) | 120 (825) | 6.0 | 50 (68) |

TABLE 2 shows the effect of time at temperature at various temperatures for $Ni_{56.5}Mo_{23.5}Fe_{10}B_{10}$. The same powder batch was used for all the tests.

EXAMPLES 10-14

A second alloy, $Ni_{60}Mo_{50}B_{10}$, was cast by melt spinning to form an amorphous alloy structure. The alloy was pulverized and HIP'ed, as previously described. The effect of consolidation temperature was examined in the range 1000° to 1250° C. The equilibrium melting point of this alloy was 1260° C., as determined by D.T.A. (Differential Thermal Analysis).

The toughness increased with temperature in a near linear manner, as representatively shown in TABLE 3. Between 1200° to 1250° C., however, the toughness did not increase, while the hardness continued to decrease, indicating that a further increase in temperature would result in a decrease in toughness. This would also be expected to result in equilibrium melting.

The homogeneous microstructure of the rapidly solidified powder again allowed processing at much higher temperatures, than would be expected. In fact, the powder was processed at a remarkable 0.992 of the melting temperature, as measured in °C.

The alloy $Ni_{60}Mo_{50}B_{10}$ may be hardened by exposure to 800° C. for around 4 hrs. This produces ordered $Ni_4Mo$ and $Ni_3Mo$ phases in the tough nickel matrix. This hardens the matrix, but also decreases its toughness. For HIP material this gives an overall increase in hardness of 1 to 2 HRc and a decrease in toughness. For example, the impact resistance of the material HIP'ed at 1000° C. is reduced from about 5 ft lbs to about 2-3 ft lbs. For the material HIP'ed at 1200° C. the impact resistance is reduced from about 9 ft lbs to about 5-6 ft lbs. Thus, while high temperature consolidation still increases the toughness, the amount of increase is reduced. This illustrates the importance of the toughness of the matrix in determining the magnitude of the benefit resulting from high temperature consolidation.

TABLE 3

| Temperature | 1000° C. | 1050° C. | 1150° C. | 1200° C. | 1250° C. |
|---|---|---|---|---|---|
| Hrc | 63.5 | 60.5 | 58 | 58 | 56 |
| Unnotched impact, ft-lbs (Joules) | 5 (6) | 6 (8) | 8 (11) | 9 (12) | 8 (11) |
| Boride size, micrometers | <1 | 1.5 | 3.5 | 3.5 | 9 |

TABLE 3 shows the effect of consolidation temperature after 2 hours at temperature on the properties after HIP'ing of $Ni_{60}Mo_{30}B_{10}$.

EXAMPLES 15-17

A consolidation technique which produces shear, such as extrusion or forging, results in better interparticle bonding than one which only presses the powder isostatically. One would expect that the effect of temperature on toughness would be less for extrusion than for HIP'ing. To determine the effect of extrusion temperature on toughness, the alloy $Ni_{60}Mo_{30}B_{10}$ was extruded at different temperatures. The alloy was cast, pulverized and canned as described in Example 1. The extrusion included the steps of preheating the can for 2 hours and extruding through an 18:1 reduction ratio die to produce a cylindrical rod.

Surprisingly the properties of the extruded rods were found to be more dependent on temperature than the HIP'ed material; the toughness increased significantly with increased preheat temperature, as representatively shown in TABLE 4.

TABLE 4

| Extrusion Temperature; °C. | Boride Size; microns | HRc | Unnotched Impact; ft-lbs (Joules) |
|---|---|---|---|
| 1050 | <1 | 61.5 | 20 (27) |
| 1065 | — | 58.5 | 18 (24) |
| 1100 | 2 | 56.5 | 41 (56) |

TABLE 4 shows the effect of extrusion temperature on some properties of $Ni_{60}Mo_{30}B_{10}$.

EXAMPLES 18–21

The effect of high temperature consolidation was also investigated using a $W_{35}Ni_{40}Fe_{18}B_7$ alloy. This alloy contained tungsten spheres in a nickel base matrix. The alloy was melt spun, pulverized and extruded as described in Example 4, except that an extrusion ratio of 12:1 was employed.

The toughness of the alloy increased with preheat temperature, as representatively shown in TABLE 5. It is particularly noteworthy that a preheat temperature of 1280° C. did not decrease the toughness, even though a temperature rise of around 100° C. during extrusion may be expected and the equilibrium start of melting temperature of the alloy was 1330° C.

TABLE 5

| Extrusion Temperature [°C.] | 1150 | 1200 | 1250 | 1280 |
|---|---|---|---|---|
| HRc | 48.5 | 40 | 40 | 40 |
| Unnotched Impact Resistance, ft-lbs (Joules) | 14.5 (20) | 17 (23) | 25 (34) | 25 (34) |
| UTS; Kpsi, (MPa) | 194 (1350) | 159 (1100) | — | — |
| Elongation; % | 0 | 0.4 | — | — |

TABLE 5 shows some properties of $W_{35}Ni_{40}Be_{18}B_7$ as a function of the extrusion temperature.

EXAMPLE 22

The use of rapidly solidified powders also allows heat treatments or sintering at temperatures much higher than would be expected from conventional powder metallurgy. This is the case even for material which has already been consolidated and which already contains precipitate. A subsequent high temperature heat treatment of such material can increase toughness. The toughness increase is not as great as when pressure is also applied, as in the case of HIP'ing. However, factors such as the lower cost of operating a furnace compared to a HIP unit may make the use of subsequent heat treatment more attractive.

The boride sizes, after heat treatment at various temperatures, of material consolidated under standard HIP conditions are representatively shown in TABLE 6.

TABLE 6

| Temperature [°C.] | 1150 | 1200 | 1250 |
|---|---|---|---|
| Boride size; microns | 2.5 | 3.2 | 6.0 |

TABLE 6 shows the effect of the heat treatment temperature after 2 hrs at temperature on the boride size of $Ni_{60}Mo_{30}B_{10}$.

EXAMPLE 23

The alloy $Ni_{56.5}Mo_{23.5}Fe_{10}B_{10}$ was extruded in accordance with the procedure outlined in Examples 15–17. The shear occurring during the extrusion increased the toughness of this alloy, compared to a HIP'ed material. For the same hardness of 47 to 49 HRc, the toughness generally increased from about 35 ft lbs. (45 J) up to about 80 ft lbs. (110 J).

Two bars, which where extruded at approximately 1080° C., were machined into impact specimens and employed to investigate the effect of a subsequent, higher temperature heat treatment. Individual impact bars were placed in a vacuum furnace, exposed to selected temperatures which ranged from 1150° C. to 1225° C. for 4 hours, and then cooled in a furnace. Cooling from the treatment temperature down to around 600° C. usually took about ½ hour. The extruded material can be considered to have been fast cooled. An even faster quench should reduce the hardness by around 1 HRc and improve the toughness slightly.

The properties of the heat treated material are shown in TABLE 7. Again the hardness decreased with heat treatment temperature, while the toughness increased when heat treated at temperatures up to around 1200° C. Therefore, it is apparent that even a relatively tough alloy with good interparticle bonds can be increased in toughness by the high temperature heat treatment of the invention.

TABLE 7

| | As Extruded (1080° C.) | Heat Treated in Vacuum for 4 hours 1150° C. | 1200° C. | 1225° C. |
|---|---|---|---|---|
| HRc | 46 | 42 | 42 | 38 |
| Unnotched Impact; ft lbs. (Joules) | 85 (114) | 95 (128) | 100 (135) | 95 (128) |
| Boride Size; microns | 1.2 | 2.25 | 2.45 | 3.55 |

Average properties obtained from extruded bars of $Ni_{56.5}Mo_{23.5}Fe_{10}B_{10}$

EXAMPLE 24

The alloy $Ni_{56.5}Mo_{23.5}Fe_{10}B_{10}$ was extruded, as described in Example 23, but at a higher temperature, 1175° C. It was then heat treated at selected temperatures ranging from 1100° C. to 1225° C. This high temperature extrusion had a significant center defect along its complete length, which significantly reduced the impact resistance and increased the scatter in the impact data. To compensate, at least 2 tests were carried out at each condition. The as-extruded impact resistance was 65 ft lbs. compared to the usual value of approximately 80 ft lbs. (With a good extrusion without defects, the higher extrusion temperature can be expected to give a higher impact resistance than the standard value of 80 ft lbs.) For the purposes of this example, the effect of the heat treatment should be compared to the lower 65 ft lbs. value. The data in TABLE 8 shows that the high temperature heat treatment is very beneficial for the higher temperature extruded material. Despite the center line defect, toughness values at high as 135 ft lbs. (180 J) were obtained, while the hardness values were maintained at 38–44 HRc, which are comparable to the HRc of competing materials, such as stellites. The toughness values were, of course, significantly superior to those of stellites. The properties shown in TABLES 7 and 8 are not optimized, but are intended simply to illustrate the effects of extrusion temperature and subsequent heat treatment temperature. It is clear from these examples that further improved properties are obtainable by optimizing extrusion temperature and the subsequent heat treatment temperature and time.

TABLE 8

| | As Extruded | Heat Treated in Vacuum for 4 hours | | | |
|---|---|---|---|---|---|
| | (1175° C.) | 1100° C. | 1150° C. | 1175° C. | 1225° C. |
| HRc | 42 | 44 | 38 | 40 | 38 |
| Unnotched Impact; ft lbs. (Joules) | 65 (88) | 136 (184) | 135 (182) | 100 (135) | 110 (148) |
| Boride Size; microns | 2.4 | 2.7 | — | — | 3.0 |

The heat treated specimens were cooled down to 600° C. during a ½ hour time period.

Having thus described the invention in rather full detail, it will be understood that such details need not be strictly adhered to but that various changes and modification may suggest themselves to one skilled in the art, all falling within the scope of the invention as defined by the subjoined claims.

I claim:

1. A method for producing a consolidated article having increased toughness, comprising the steps of:
   (a) selecting a rapidly solidified alloy, which has been solidified at a quench rate of at least about $10^{5}$° C./sec and has a substantially homogeneous, optically featureless alloy structure;
   (b) forming said rapidly solidified alloy into a plurality of separate alloy bodies;
   (c) heating said rapidly solidified alloy bodies to a temperature ranging from about 0.90–0.99 Tm (melting temperature measured in ° C.) for a time period ranging from about 1 min. to about 24 hrs; and
   (d) compacting said rapidly solidified alloy bodies to produce a consolidated article composed of a crystalline alloy, which has an average grain size of greater than 3 micrometers and contains a substantially uniform dispersion of separate precipitate particles having an average size ranging from about 3–25 micrometers.

2. A method as recited in claim 1, wherein said rapidly solidified alloy consisting essentially of the formula $M_{bal}T_aR_bCr_cX_dY_e$, wherein "M" is at least one element selected from the group consisting of Fe, Co and Ni, "T" is at least one element selected from the group consisting of W, Mo, Nb and Ta, "R" is at least one element selected from the group consisting of Al and Ti, "X" is at least one element selected from the group consisting of B and C, "Y" is at least one element selected from the group consisting of Si and P, "a" ranges from about 0–40 at %, "b" ranges from about 0–40 at %, "c" ranges from about 0–40 at %, "d" ranges from about 5–25 at %, and "e" ranges from about 0–15 at %.

3. A method as recited in claim 1, wherein said heating step (c) is performed prior to said compacting step (d).

4. A method as recited in claim 1, wherein said heating step (c) is performed during said compacting step (d).

5. A method as recited in claim 1, wherein said heating step (c) is performed after said compacting step (d).

6. A method as recited in claim 1, wherein said rapidly solidified alloy is heated to said temperature for a time period ranging from 0.5–12 hr.

7. A method as recited in claim 1, wherein said rapidly solidified alloy is heated to a temperature ranging from about 0.96–0.99 Tm.

8. A method as recited in claim 1, wherein said compacting step (d) is comprised of extrusion.

9. A method as recited in claim 1, wherein said compacting step (d) is comprised of forging.

10. A method as recited in claim 1, wherein said rapidly solidified alloy consists essentially of the formula $M_{bal}'B_{5-25}X_{0-20}'$, wherein M' is at least one element selected from the group consisting of Fe, Co, W, Mo and Ni, X' is at least one element selected from the group consisting of C and Si, and the subscripts are in at %.

11. A method as recited in claim 9, wherein said rapidly solidified alloy is heated to said temperature for a time period ranging from 0.5–12 hr.

12. A method as recited in claim 9, wherein said rapidly solidified alloy is heated to a temperature ranging from about 0.96–0.99 Tm.

13. A method for producing a consolidated article having increased toughness, comprising the steps of:
   (a) selecting a rapidly solidified alloy, which has been solidified at a quench rate of at least about $10^{5}$° C./sec and has a substantially homogeneous, optically featureless alloy structure;
   (b) forming said rapidly solidified alloy into a plurality of separate alloy bodies;
   (c) heating said rapidly solidified alloy bodies to a temperature ranging from about 0.96–0.99 Tm (melting temperature measured in °C.) for a time period ranging from about 1 min. to about 24 hrs; and
   (d) compacting said rapidly solidified alloy bodies to produce a consolidated article composed of crystalline alloy, which has an average grain size of greater than 3 micrometers and contains a substantially uniform dispersion of separate precipitate particles having an average size ranging from about 3–25 micrometers.

14. A consolidated article composed of a crystalline alloy consisting essentially of the formula $M_{bal}T_aR_bCr_cX_dY_e$, wherein M is at least one element selected from the group consisting of Fe, Co, and Ni, T is at least one element selected from the group consisting of W, Mo, Nb and Ta, R is at least one element selected from the group consisting of Al and Ti, X. is at least one element selected from the group consisting of B and C, Y is at least one element selected from the group consisting of Si and P, "a" ranges from about 0–40 at %, "b" ranges from about 0–40 at %, "c" ranges from about 0–40 at %, "d" ranges from about 5–25 at % and "e" ranges from about 0–15 at %, said alloy having an average grain size of greater than 3 micrometers and containing a substantially uniform dispersion of separate precipitate particles that have an average size ranging from about 3–25 micrometers.

15. A consolidated article as recited in claim 14, wherein said alloy has an ultimate tensile strength of at least about 1200 MPa and an impact resistance of at least about 10 Joules (unnotched charpy test).

16. A consolidated article as recited in claim 14, wherein said separate precipitate particles have an average size ranging from about 3–15 micrometers.

17. A consolidated article as recited in claim 14, wherein said average grain size ranges from about 6–10 micrometers.

18. A consolidated article composed of a crystalline alloy consisting essentially of the formula $M_{bal}'B_{5-25}X_{0-20}'$, wherein M′ is at least one element selected from the group consisting of Fe, Co, W, Mo and Ni, X′ is at least one element selected from the group consisting of C and Si, and the subscripts are in atom percent; said alloy having an average grain size of greater than 3 micrometers and containing a substantially uniform dispersion of separate precipitate particles that have an average size ranging from about 3–25 micrometers.

19. A consolidated article as recited in claim 18, wherein said alloy has an ultimate tensile strength of at least about 1200 MPa and an impact resistance of at least about 10 Joules (unnotched charpy test).

* * * * *

UNITED STATES PATENT AND TRADEMARK OFFICE

CERTIFICATE OF CORRECTION

PATENT NO. : 4,582,536

DATED : April 15, 1986

INVENTOR(S) : Derek Raybould

It is certified that error appears in the above-identified patent and that said Letters Patent is hereby corrected as shown below:

Col. 13, line 14 "$M_{bal}'B_{5-25}X_{0-20}'$," should read and --$M'_{bal}B_{5-25}X'_{0-20}$ --

Col. 14, line 1

Signed and Sealed this

Fourth Day of November, 1986

[SEAL]

*Attest:*

DONALD J. QUIGG

*Attesting Officer*

*Commissioner of Patents and Trademarks*